US005221132A

United States Patent [19]

Combs et al.

[11] Patent Number: 5,221,132

[45] Date of Patent: Jun. 22, 1993

[54] TOOL STORAGE SYSTEM WITH MAGNETIC SWINGING ARMS

[76] Inventors: Max Combs; Mary K. Combs, both of 390 E. 700 North, Price, Utah 84501

[21] Appl. No.: 752,858

[22] Filed: Aug. 30, 1991

[51] Int. Cl.[5] ..... A47B 88/00

[52] U.S. Cl. ..... 312/310; 248/206.5; 211/DIG. 1; 211/70; 211/70.6; 312/902

[58] Field of Search ..... 312/902, 310; 211/DIG. 1, 70.6, 70.7, 96, 70, 102; 248/206.5; 206/350; 269/8

[56] References Cited

U.S. PATENT DOCUMENTS

| | | | |
|---|---|---|---|
| 969,620 | 9/1910 | Hengel | 312/902 |
| 2,733,113 | 1/1956 | Humbargar | 211/DIG. 1 |
| 2,966,992 | 1/1961 | Dunnkelberger et al. | 211/87 |
| 3,776,387 | 12/1973 | Brent | 211/DIG. 1 |
| 3,842,980 | 10/1974 | Kushner | 211/60 T |
| 3,868,016 | 2/1975 | Szpur et al. | 206/350 |
| 4,183,439 | 1/1980 | Bell | 211/60 T |
| 4,342,492 | 8/1982 | Spevak | 312/902 |
| 4,497,412 | 2/1985 | Labelle | 211/60 T |
| 4,544,067 | 10/1985 | Miller | 211/70.6 |
| 4,802,580 | 2/1989 | Andersen | 206/378 |
| 4,826,059 | 5/1989 | Bosch et al. | 224/183 |

FOREIGN PATENT DOCUMENTS

| | | | |
|---|---|---|---|
| 0307578 | 3/1929 | United Kingdom | 211/DIG. 1 |

OTHER PUBLICATIONS

Pp. 21-28 of Snap-on, 1990, products catalog.

*Primary Examiner*—Kenneth J. Dorner
*Assistant Examiner*—Gerard A. Anderson
*Attorney, Agent, or Firm*—Madson & Metcalf

[57] ABSTRACT

The tool storage system of the present invention comprises a framework, one or more pivot pins, a plurality of swinging arms, and an attachment assembly for each swinging arm. The framework is configured to attach to the front, top, or end of a conventional tool cabinet or to be constructed as part of a custom tool cabinet. The pivot pins are connected to the framework in a manner that permits their removal. Each swinging arm is connected to an attachment assembly which is pivotally mounted to one of the pivot pins, thereby permitting the swinging arms to pivotally swing from a storage mode to a ready access position. Each swinging arm comprises a magnetic material to which tools may be secured by magnetic attraction. Since the swinging arms swing into a position for ready access, tools may be magnetically secured to both the front and back of each swinging arm. For large and/or heavy tools, two or more adjacent swinging arms may be used to secure the tools. Also, each swinging arm may be secured in the storage mode by a latch.

31 Claims, 5 Drawing Sheets

TOOL STORAGE SYSTEM WITH MAGNETIC SWINGING ARMS

FIELD OF THE INVENTION

The present invention relates to an apparatus used for storing tools and other hand implements for easy access, and more particularly to a tool storage system utilizing magnetic swinging arms.

BACKGROUND OF THE INVENTION

A mechanic's tools are the instruments with which he makes his living. Oftentimes, whether or not a particular repair can be done is a question of whether the mechanic has the right tool for the job. As a result, mechanics typically acquire a large selection of hand tools.

Management of a mechanic's selection of tools can be a monumental task without organization, discipline, and tool storage facilities. When a particular tool is needed, there is a degree of time urgency involved because a mechanic does not want to scour his tool box searching for the right tool. Such searching can be a needless waste of time and effort. Also, it is often the case that a mechanic has only one hand free to engage in the search for the right tool. The free hand frequently must move aside other tools to uncover the desired tool, an activity that can be difficult and frustrating. Additionally, injuries and accidents have occurred during the search for a tool.

Many times the search for the right tool is an exercise in futility because the tool has been lost or misplaced. Short of performing an extensive inventory of the tools, the mechanic may not be able to determine with certainty that a particular tool is missing. Hence, mechanics frequently purchase a new tool to replace one believed to be lost, only to later find the tool that had eluded discovery during a frantic search. This needless duplication of tools is an expensive practice that most mechanics wish to avoid.

The problems inherent in tool management are readily known, and over the years, tool boxes and cabinets and other tool organizers have been developed. Ideally, a tool storage system must organize the tools for easy location and accessibility. It must reduce the likelihood that a tool will be misplaced or lost. It must also secure the tools from theft.

OBJECTS AND BRIEF SUMMARY OF THE INVENTION

In view of the foregoing needs and problems experienced by mechanics and other users of hand tools and hand implements, it is a primary object of the present invention to provide a tool storage system that positions tools for easy access and improves tool management.

It is another object of the present invention to provide a tool storage system that displays the tools in a manner which enables one to take a quick visual inventory of the tools to determine if tools are missing.

A further object of the present invention is to provide a tool storage system that can be secured to discourage or prevent theft.

Another object of the present invention is to provide tool storage system that is mobile so that the inventory of tools can be moved to a position where all of the tools can be accessible.

Still another object of the present invention is to provide a tool storage system that may be retrofit to an existing tool cabinet to enhance its utility.

The foregoing objects are accomplished by an apparatus of the present invention which facilitates the storage of tools in an orderly fashion. The tool storage system of the present invention comprises a framework, one or more pivot pins, a plurality of swinging arms, and an attachment assembly for each swinging arm. The framework is configured to attach to the front, top, or end of a conventional tool cabinet or to be constructed as part of a custom tool cabinet. The pivot pins are connected to the framework in a manner that permits their removal. Each swinging arm is connected to an attachment assembly which is pivotally mounted to one of the pivot pins, thereby permitting the swinging arms to pivotally swing from a storage mode to a ready access position. Each swinging arm comprises a magnetic material to which tools may be secured by magnetic attraction. Since the swinging arms swing into a position for ready access, tools may be magnetically secured to both the front and back of each swinging arm. For large and/or heavy tools, two or more adjacent swinging arms may be used to secure the tools. Also, each swinging arm may be secured in the storage mode by a latch.

In one preferred embodiment of the present invention the tool storage system is disposed on the front of a tool cabinet so that a roll-up interlocking slat door can be drawn over the tools and swinging arms and secured by a locking mechanism.

In another embodiment of the present invention the tool storage system disposed on the top of a tool cabinet has a hinge connection which enables the system to rest horizontally for storage and open to a vertical disposition for use.

In still another embodiment of the present invention the tool storage system disposed on the end of a tool cabinet has a vertical hinge connection which enables the system to swing between open and closed positions.

A further embodiment of the present invention provides a tool storage system which is a combination of front, top, and/or end tool storage units for retrofit to an existing tool cabinet.

These and other objects and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described an explained with additional specificity and detail through the use of the accompanying drawings in which.

DETAILED DESCRIPTION OF THE PREFERRED EMBODIMENTS

Figure 1:
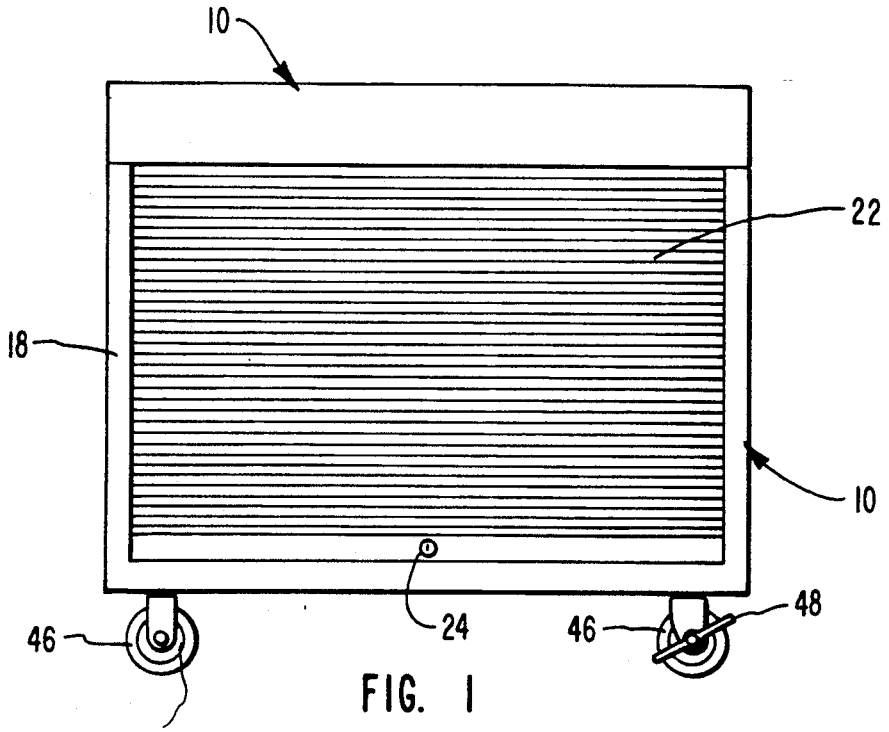
FIG. 1 is a front elevational view of a tool storage system of the present invention showing a roll-up interlocking slat door closed and secured.

Referring now specifically to the drawings, wherein like numerals indicate like parts throughout, the tool storage system of the present invention comprises a framework, generally designated 10, one or more pivot pins 12, a plurality of swinging arms 14, and an attachment assembly 16 for each swinging arm 14.

Figure 7:
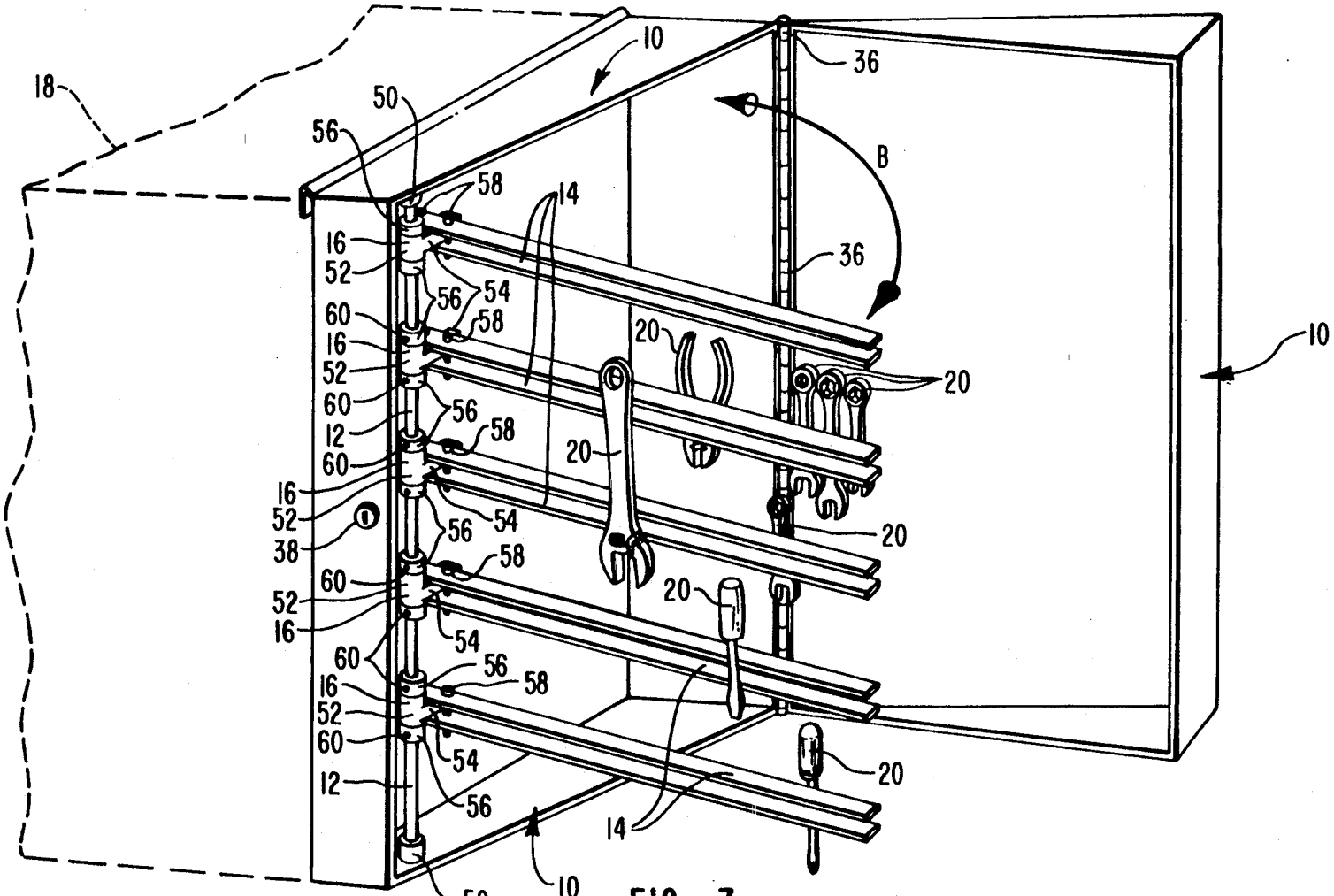
FIG. 7 is a perspective view of an end unit capable of retrofit to an existing tool cabinet (shown in phantom lines).

Framework 10 may be configured to attach to the front, top, or end of a conventional tool cabinet 18 or to be constructed as part of a custom tool cabinet. FIG. 1 illustrates a tool storage system of the present invention having a framework 10 attached to the front of a tool cabinet 18. With the preferred embodiment shown in FIG. 1, tools (not shown, but designated 20 as shown in FIG. 7) are secured in a storage mode by a roll-up interlocking slat door 22. The interlocking slat door 22 may be secured by a locking mechanism 24 to protect tools 20 from theft. As shown best in FIGS. 2 and 3, the interlocking slat door 22 may be rolled up into a storage channel 26 to permit access to tools 20 disposed on the swinging arms 14.

Figure 2:
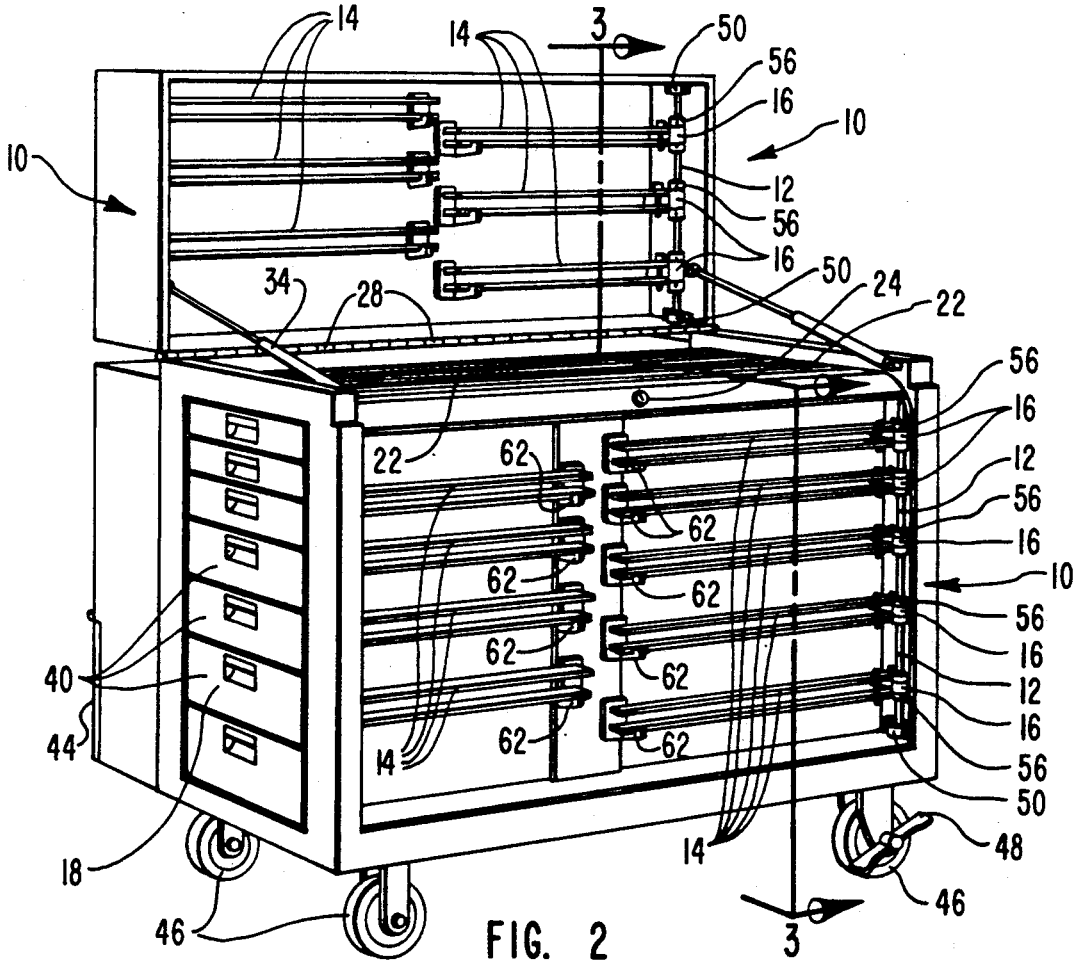
FIG. 2 is a perspective view of one preferred embodiment of the present invention showing the top and front storage areas open.
Figure 3:
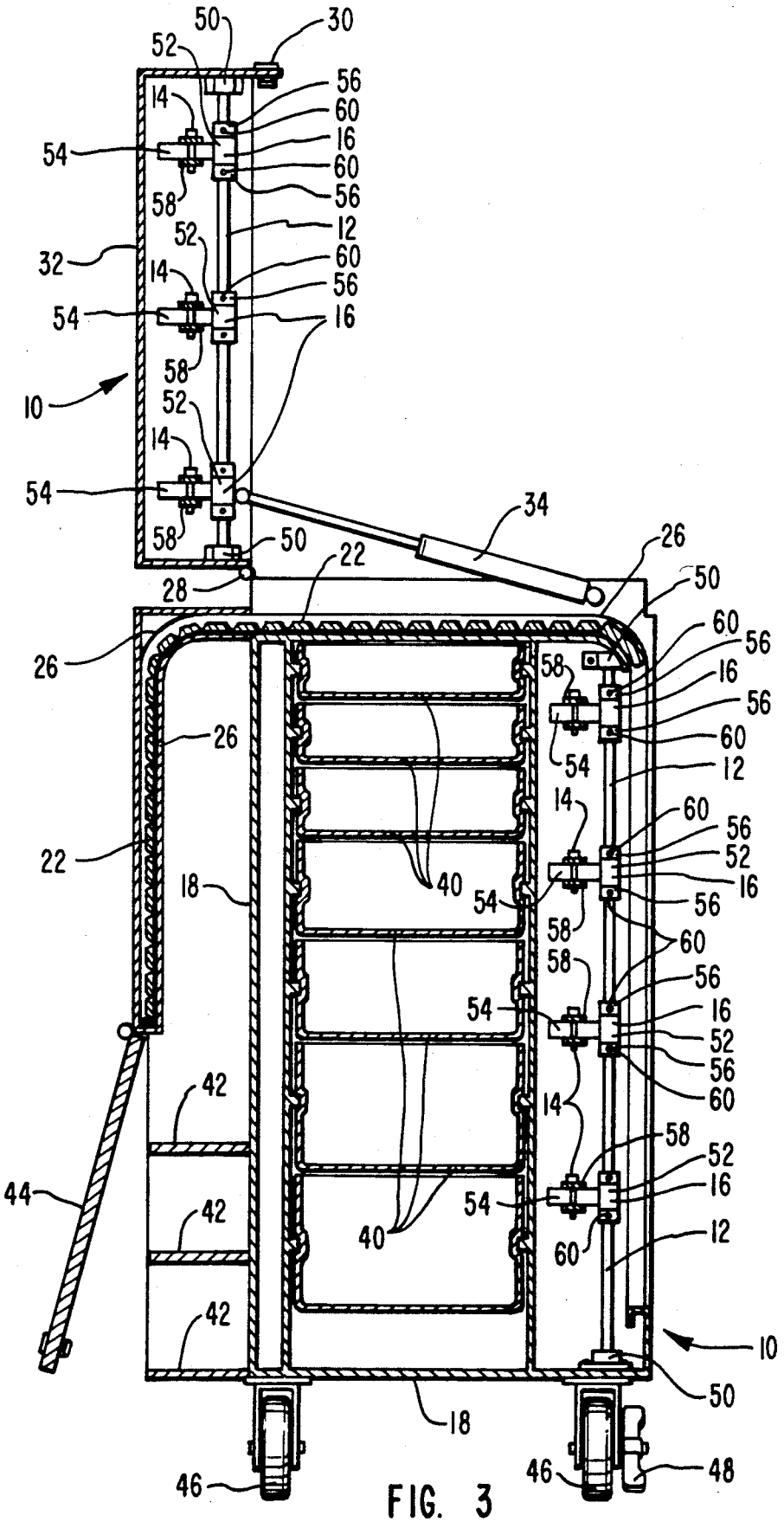
FIG. 3 is a vertical sectional view of the tool storage system of FIG. 2 along line 3—3 and showing the internal areas of one type of system.
Figure 5:
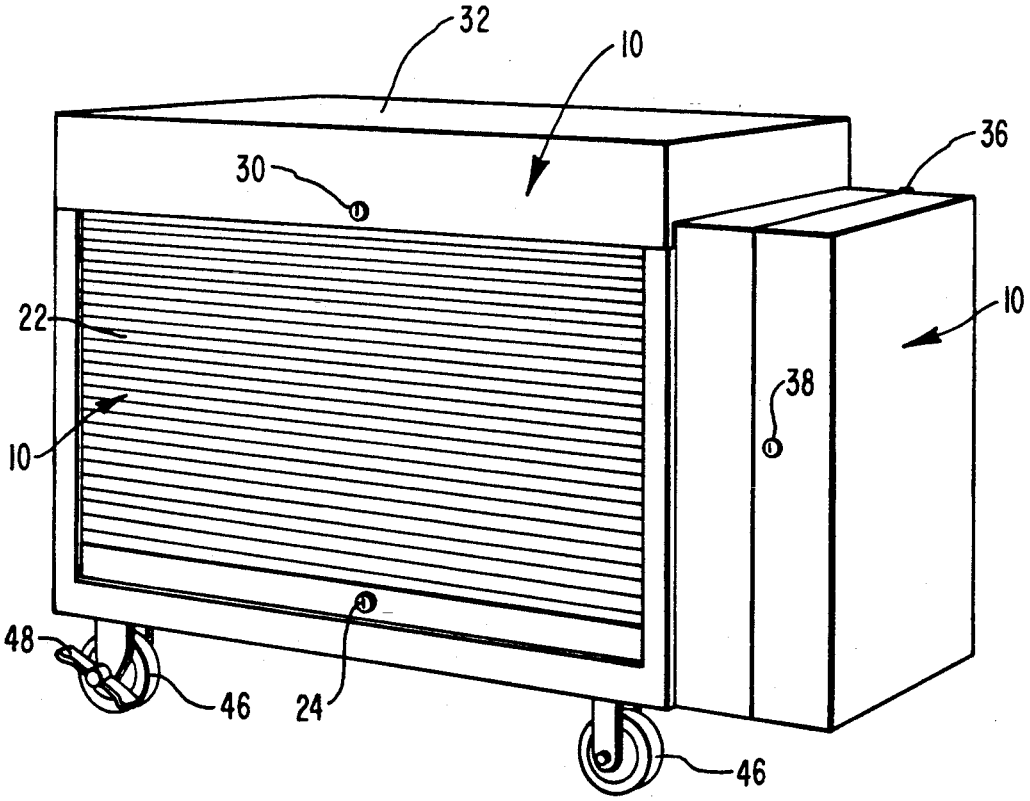
FIG. 5 is a perspective view of another preferred embodiment of the present invention showing a tool storage system with an end unit attached.
Figure 6:
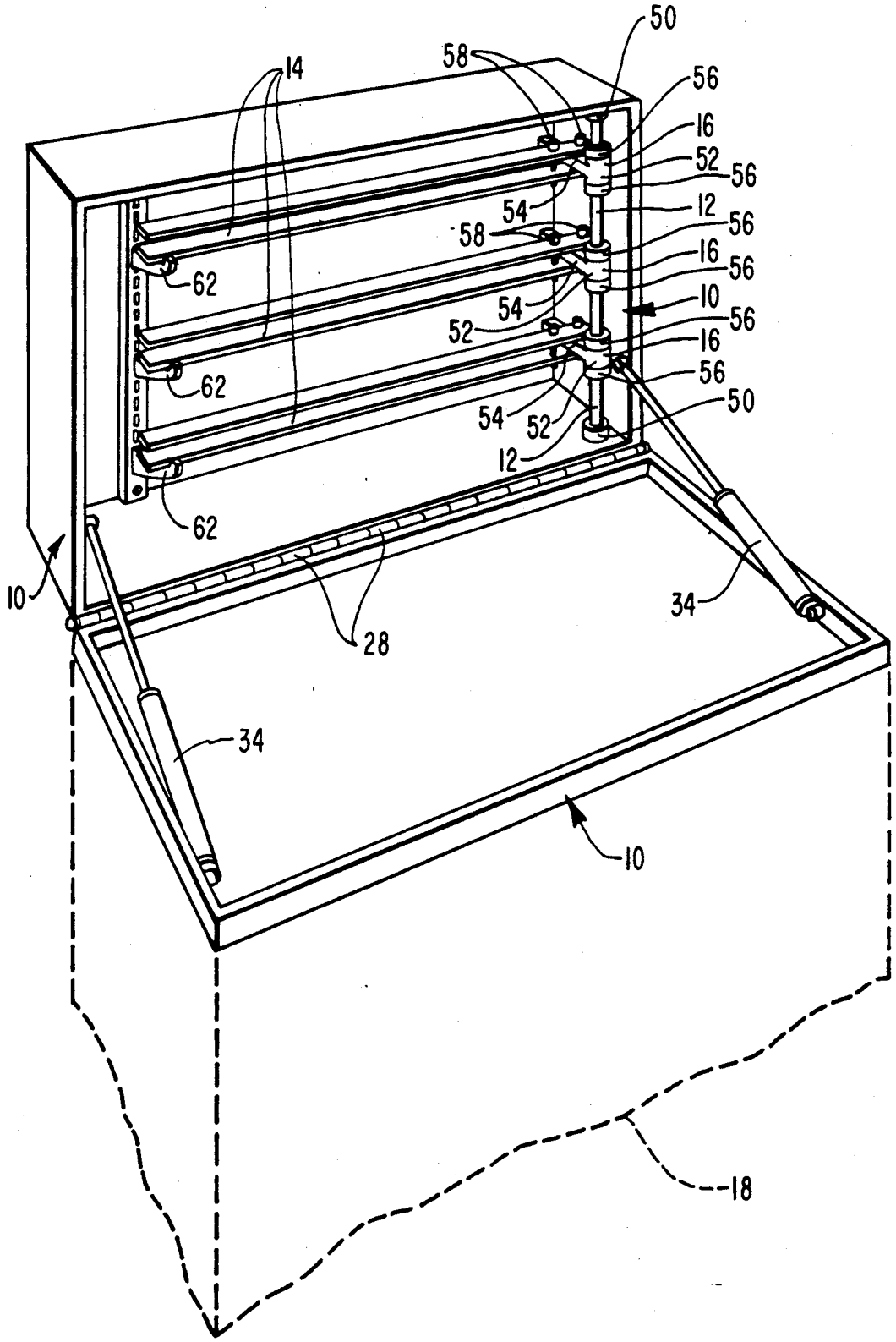
FIG. 6 is a perspective view of a top unit capable of retrofit to an existing tool cabinet (shown in phantom lines)

FIGS. 2–3 and 5–6 illustrate a tool storage system of the present invention having a framework 10 attached to the top of a tool cabinet 18 in hinged engagement. A hinge 28 is disposed in a generally horizontal plane about which the framework 10 may swing from a closed position (FIG. 5) to an open position (FIGS. 2–3 and 6). In the closed position, the framework 10 may be secured by a locking mechanism 30 to protect tools 20 from theft and to provide a flat surface 32 for a work area. In the open position, the framework 10 is supported by gas assisted braces 34 so that the framework 10 is held in the open position and will not inadvertently crash closed if jarred or moved. Also, in the open position, the pivot pins 12 are disposed in a generally vertical plane so that the swing arms 14 will swing horizontally for access by the user. Further, the top of the tool cabinet 18 may serve as a flat surface work area when the framework 10 is in an open position.

FIGS. 5 and 7 illustrate a tool storage system of the present invention having a framework 10 attached to the end or side of a tool cabinet 18 in hinged engagement. A hinge 36 is disposed in a generally vertical plane about which the framework 10 may swing from a closed position (FIG. 5) to an open position (FIG. 7). In the closed position, the framework 10 may be secured by a locking mechanism 38 to protect tools 20 from theft. In the open position, the swing arm 14 are exposed so that they may swing horizontally (as shown by Arrow B) for access by the user.

In the drawings, the tool cabinet 18 illustrated has a plurality of end drawers 40, rear storage shelves 42 accessible through a rear door 44, and caster wheels 46 with foot pedal brakes 48. It should be understood; however, that the tool storage system of the present invention may be retrofit or custom built to a great variety of tool cabinets 18 now conventionally available without departing from the intent and spirit of this invention. Although, many types of tool cabinets 18 may be used, it is preferred that the tool cabinet 18 have caster wheels 46 so that the tool cabinet 18 and the tool storage system of the present invention is mobile whereby the swinging arms 14 may be positioned for optimum accessibility.

Pivot pins 12 are connected to the framework 10 such that each end of a pivot pin 12 is captured within a rest 50 which secures the pivot pin 12 from rotational movement. Preferably, the rest 50 permits the removal of the pivot pin 12 so that swinging arms 14 can be added or subtracted from connection to the pivot pin 12 by merely sliding the swinging arm 14 on or off. Although, it is described herein that the pivot pins 12 do not rotate so that each swinging arm 14 may be moved independent of the other swinging arms 14, it should be understood that the rests 50 may permit rotation of the pivot pins 12 so that all of the swinging arms 14 secured to a single pivot pin 12 may be moved simultaneously.

In order that the swinging arms 14 swing in a generally horizontal plane, it is preferred that the pivot pins 12 be disposed generally vertical when the framework 10 is open and deployed for use. In this manner, gravity will not act upon the swinging arms 14 to cause them to swing out or in. Rather, the movement of the swinging arms 14 is controlled by the user of the tool storage system.

Figure 4:
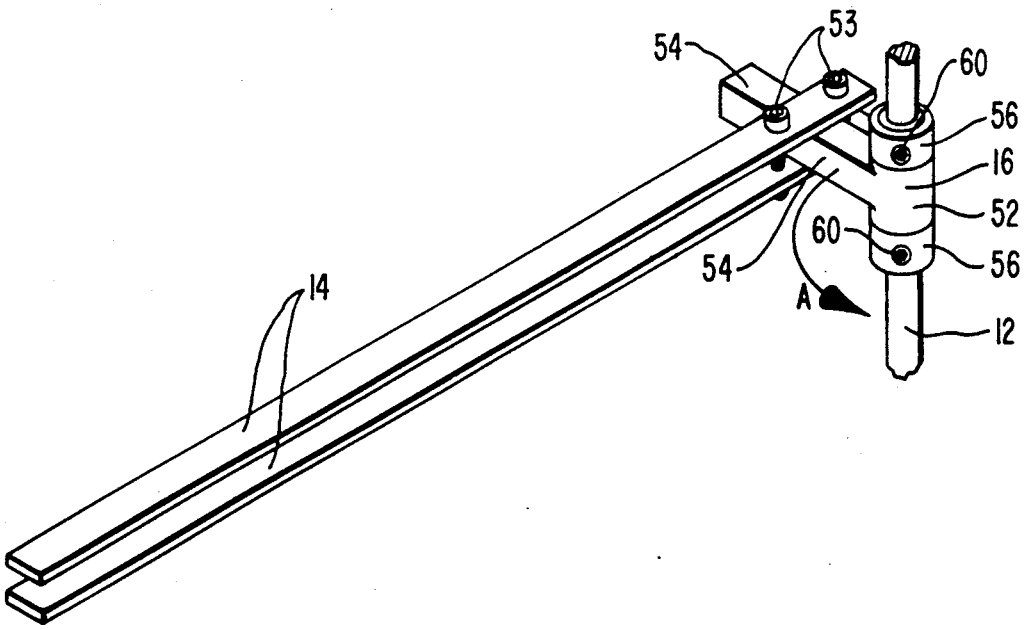
FIG. 4 is a perspective view of one of the swinging arms showing the attachment assembly.

Each swinging arm 14 is connected to an attachment assembly 16 which is pivotally mounted to one of the pivot pins 12, thereby permitting the swinging arms 14 to pivotally swing from a storage mode to a ready access position. As best shown in FIG. 4, the attachment assembly 16 comprises a jacket 52 with a tongue 54, one or more locking collars 56, and a clamping mechanism 58. The attachment assembly 16 serves as a means for securing a swinging arm 14 to a pivot pin 12. In a preferred embodiment, the jacket 52 is freely pivotal about a stationary pivot pin 12. The jacket 52 is supported by a locking collar 56 which is secured to the pivot pin 12 by set screws 60. With this type of attachment, the tongue 54 is free to swing as shown by Arrow A in FIG. 4. Since the set screws 60 of the locking collars 56 may be loosened, the locking collars 56 are capable of selective disposition longitudinally along the pivot pin 12. Hence, the user of the tool storage system of the present invention may configure the swinging arms 14 for a custom deployment of the tools 20 the user possesses. Swinging arms 14 can be positioned close to each other so that large and/or heavy tools 20 may be secured to more than one swinging arm 14 (see FIG. 7). Also, if the pivot pin 12 is positioned to always be disposed in a generally vertical plane, only one locking collar 56 is necessary to support and position the jacket 52 of each swinging arm 14 connected to that pivot pin 12.

As described above, the pivot pin 12 is stationary and the swinging arms 14 rotate freely about the pivot pin 12. It should be understood; however, that it is contemplated by this invention that the swinging arms 14 be secured to rotating pivot pins 12 so that the swinging arms 14 on a single pivot pin 12 move in unison by rotating the pivot pin 12. Of course, with this alternative embodiment, the manner of connecting the swinging arm 14 to a pivot pin 12 will differ slightly, and is considered to be within the knowledge of one skilled in the art. Further, the attachment assembly 16 could be configured to permit a combination of free rotational movement by the swinging arms 14 and movement in unison, according to the manner of movement selected by the user.

Adjustability of the depth of the swinging arm 14 within the tool storage system is provided by the tongue 54 which is disposed generally perpendicular to the longitudinal axis of the pivot pin 12. The attachment end of each swinging arm 14 is capable of selective disposition longitudinally along the tongue 54. This permits lateral adjustment of the swinging arm 14 with respect to the pivot pin 12 and allows for depth adjustment of the swinging arm 14 within the tool storage system. Once the desired depth is determined, the swinging arm 14 is secured to the tongue 54 by tightening the clamping mechanism 58. If the user desires at a later time to adjust the depth, the user merely loosens the clamping mechanism 58, slides the swinging arm 14 to the desired depth, and tightens the clamping mechanism 58 to secure the swinging arm 14 in place.

Although it is illustrated in FIG. 4 that the clamping mechanism 58 comprises a pair of bolts, any means of securement may be used that permits the sliding engagement with and capture of the tongue 54. For example, the swinging arm 14 could be equipped with set screws which engage the tongue directly.

It is contemplated that each swinging arm 14 be constructed, at least in part, of a magnetically conductive material to which tools 20 may be secured by magnetic attraction. Since the swinging arms 14 swing into a position for ready access (see Arrow B, FIG. 7), it is preferred that both the front and the back of the swinging arms 14 be magnetic so that tools 20 may be magnetically secured to both the front and back of each swinging arm 14. As mentioned above, large and/or heavy tools 20, may be secured to two or more adjacent swinging arms 14. In order to restrain the swinging arms 14 from undesired movement while disposed in the storage mode, a hook or latch 62 is provided to capture and restrain the distal end of the swinging arm 14. During movement of the tool storage system or if the tool storage system is positioned on uneven ground, the latch 62 restrains the distal end of a swinging arm 14 from undesired movement.

The tool storage system of the invention described herein may be retrofit to an existing tool cabinet 18 or built into a custom designed tool cabinet 18, and is mobile if attached to a tool cabinet 18 with wheels 46 such as many conventional tool cabinets 18 have. The tool storage system can be secured from theft by using locking mechanisms 24, 30, 38 which secure the system in a closed disposition. However, once deployed in its open position, tools 20 are available for easy and rapid access, and most importantly, the user may visually inventory his selection of tools 20 at a glance. Additionally, the swing arms 14 can be positioned for ready access to tools 20 disposed both on the front and back of the swing arms 14.

The swinging arms 14 of the tool storage system provide advantageous features for tool storage. The swinging arm 14 offer the user the opportunity to configure his selection of tools 20 in a customized fashion because the number of swinging arms 14 may be increased or decreased as desired, the height and depth of each swinging arm 14 is adjustable, and the magnetized front and back of each swinging arm 14 may be utilized because they swing into position for ready access.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for storing and managing tools comprising:

a framework;

a pivot pin connected to said framework, said pivot pin being capable of disposition in a generally vertical plane;

a swinging arm in pivotal connection with said pivot pin such that said swinging arm is capable of swinging from a first position to a second position;

means for adjustably securing said swinging arm to said pivot pin comprising a freely pivotal jacket disposed between a pair of locking collars, said locking collars being capable of selective disposition longitudinally along said pivot pin, said jacket comprising a tongue disposed generally perpendicular to the longitudinal axis of said pivot pin, said swinging arm being capable of selective disposition longitudinally along said tongue, thereby permitting lateral adjustment of said swinging arm with respect to said pivot pin; and means for removably securing tools to said swinging arm.

2. A system as set forth in claim 1, wherein said means for removably securing tools to said swinging arm is magnetic and said swinging arm comprises a magnetically conductive material.

3. A system as set forth in claim 2, wherein said swinging arm comprises a front and a back, said front and back each being magnetically conductive such that tools may be magnetically secured to both said front and said back of said swinging arm.

4. A system as set forth in claim 1, further comprising a latch for securing releasably said swinging arm in said first position and wherein said swinging arm comprises an attachment end and a distal end, said attachment end being in pivotal connection with said pivot pin and said distal end disposed for engagement with said latch.

5. A system as set forth in claim wherein the connection of said pivot pin with said framework is capable of at least partial disengagement, thereby permitting said swinging arms to be added to and removed from pivotal connection with said pivot pin.

6. A system as set forth in claim 1, wherein said system comprises at least two swinging arms proximately disposed in pivotal connection with said pivot pin such that tools may be secured to both swinging arms simultaneously.

7. A system as set forth in claim wherein said framework further comprises a roll-up interlocking slat door for securing said swinging arm from undesired access.

8. A system as set forth in claim 7, wherein said framework is connected to a mobile tool cabinet.

9. A system as set forth in claim 8, wherein the connection of said framework to said mobile tool cabinet is a hinged connection upon which said framework is capable of swinging from a closed position to an open position.

10. A system as set forth in claim 9, wherein the pivot axis of said hinge is disposed generally horizontal, whereby said pivot pin lies in a generally horizontal plane when said framework is disposed in said closed position and said pivot pin lies in a generally vertical plane when said framework is disposed in said open position.

11. A system as set forth in claim 9, wherein the pivot axis of said hinge is disposed generally vertical.

12. A system for storing and managing tools comprising:

a mobile tool cabinet;

a tool storage assembly connected to said mobile tool cabinet, said tool storage assembly comprising:

a pivot pin connected to said mobile tool cabinet;

a swinging arm connected to said pivot pin such that said swinging arm is capable of swinging from a first to a second position;

means for adjustably securing said swinging arm to said pivot pin comprising a freely pivotal jacket disposed between a pair of locking collars, said locking collars being capable of selective disposition longitudinally along said pivot pin, said jacket comprising a tongue disposed generally perpendicular to the longitudinal axis of said pivot pin, said swinging arm being capable of selective disposition longitudinally along said tongue, thereby permitting lateral adjustment of said swinging arm with respect to said pivot pin; and means for removably securing tools to said swinging arm.

13. A system as set forth in claim 12, wherein said for removably securing tools to said swinging arm is magnetic and said swinging arm comprises a magnetically conductive material.

14. A system as set forth in claim 13, wherein said swinging arm comprises a front and a back, said front and back each being magnetically conductive such that tools may be magnetically secured to both said front and said back of said swinging arm.

15. A system as set forth in claim 12, further comprising a latch for securing releasably said swinging arm in said first position and wherein said swinging arm comprises an attachment end and a distal end, said attachment end being connected to said means for adjustably securing said swinging arm to said pivot pin and said distal end disposed for engagement with said latch.

16. A system as set forth in claim 12, wherein said pivot pin is removable so that said swinging arms can be added to and removed from connection with said pivot pin.

17. A system as set forth in claim 12, wherein said system comprises at least two swinging arms proximately disposed in pivotal connection with said pivot pin such that tools may be secured to both swinging arms simultaneously.

18. A system as set forth in claim 12, wherein said tool storage assembly further comprises a roll up interlocking slat door for securing said swinging arm from undesired access.

19. A system as set forth in claim 12, wherein said connection of said tool storage assembly to said mobile tool cabinet is a hinged connection upon which said tool storage assembly is capable of swinging from a closed position to an open position.

20. A system as set forth in claim 19, wherein the pivot axis of said hinged connection is disposed generally horizontal and said tool storage assembly is connected to the top of said mobile tool cabinet.

21. A system as set forth in claim 19, wherein the pivot axis of said hinged connection is disposed generally vertical and said tool storage assembly is connected to the side of said mobile tool cabinet.

22. A system for storing and managing tools comprising:

a framework;

a pivot pin connected to said framework, said pivot pin being capable of disposition in a generally vertical plane;

a magnetic swinging arm disposable in pivotal connection with said pivot pin such that said magnetic swinging arm is capable of swinging from a first position to a second position, said magnetic swinging arm comprising a magnetically conductive material; and means for adjustably securing said magnetic swinging arm to said pivot pin comprising a freely pivotal jacket disposed between a pair of locking collars, said locking collars being capable of selective disposition longitudinally along said pivot pin, said jacket comprising a tongue disposed generally perpendicular to the longitudinal axis of said pivot pin, said magnetic swinging arm being capable of selective disposition longitudinally along said tongue, thereby permitting lateral adjustment of said magnetic swinging arm with respect to said pivot pin.

23. A system as set forth in claim 22, wherein said magnetic swinging arm comprises a front and a back, said front and back each being magnetically conductive such that tools may be magnetically secured to both said front and said back of said magnetic swinging arm.

24. A system as set forth in claim 22, further comprising a latch for securing releasably said magnetic swinging arm in said first position and wherein said magnetic swinging arm comprises an attachment end and a distal end, said attachment end being connected to said means for securing said magnetic swinging arm to said pivot pin and said distal end disposed for engagement with said latch.

25. A system as set forth in claim 22, wherein the connection of said pivot pin with said framework is capable of at least partial disengagement, thereby permitting said magnetic swinging arms to be added to and removed from pivotal connection with said pivot pin.

26. A system as set forth in claim 22, wherein said system comprises at least two magnetic swinging arms proximately disposed in pivotal connection with said pivot pi such that tools may be secured to both magnetic swinging arms simultaneously.

27. A system as set forth in claim 22, wherein said framework further comprises a roll-up interlocking slat door for securing said magnetic swinging arm from undesired access.

28. A system as set forth in claim 27, wherein said framework is connected to a mobile tool cabinet.

29. A system as set forth in claim 28, wherein the connection of said framework to said mobile tool cabinet is a hinged connection upon which said framework is capable of swinging from a closed position to an open position.

30. A system as set forth in claim 29, wherein the pivot axis of said hinge is disposed generally horizontal, whereby said pivot pin lies in a generally horizontal plane when said framework is disposed in said closed position and said pivot pin lies in a generally vertical plane when said framework is disposed in said open position.

31. A system as set forth in claim 29, wherein the pivot axis of said hinge is disposed generally vertical.

* * * * *